United States Patent [19]

Lettau

[11] Patent Number: 4,995,405

[45] Date of Patent: Feb. 26, 1991

[54] PROCESS AND APPARATUS FOR PRODUCING AROMATIZED STRAND-SHAPED SMOKING MATERIAL

[75] Inventor: K. Dieter Lettau, Konz, Fed. Rep. of Germany

[73] Assignee: R. J. Reynolds Tobacco Company, Winston-Salem, N.C.

[21] Appl. No.: 372,413

[22] Filed: Jun. 27, 1989

[30] Foreign Application Priority Data

Jun. 28, 1988 [DE] Fed. Rep. of Germany ..... 3821677

[51] Int. Cl.[5] ..... A24B 3/12; A24B 9/00

[52] U.S. Cl. ..... 131/84.1; 131/62; 131/63; 131/79; 131/31

[58] Field of Search ..... 131/31, 62, 63, 79, 131/84.1

[56] References Cited

U.S. PATENT DOCUMENTS

| | | | |
|---|---|---|---|
| 2,543,277 | 2/1951 | Copeman | 131/63 |
| 4,434,804 | 3/1984 | Bolt et al. | 131/31 |
| 4,619,276 | 10/1986 | Albertson et al. | 131/31 |

*Primary Examiner*—V. Milling
*Assistant Examiner*—J. L. Doyle

[57] ABSTRACT

Aromatized liquid is introduced into the tobacco in the area of the settling path (AS) at a point at which nearly half the final tobacco layer has accumulated. Subsequently, the second half will settle thereon so that the inserted liquid is inside the final tobacco layer (15). Liquid is injected into the tobacco without the use of compressed air, thus excluding crystal formation. The injection rate of liquid is controlled responsive to the operating speed of the cigarette making machine.

3 Claims, 1 Drawing Sheet

PROCESS AND APPARATUS FOR PRODUCING AROMATIZED STRAND-SHAPED SMOKING MATERIAL

BACKGROUND OF THE INVENTION

The invention relates to a process of the kind such as specified in the precharacterizing part of claim 1, and to an apparatus for performing the process.

During the production of cigarettes, cigars and other strand-shaped smoking material, aromatizers are frequently added to the tobacco, one of the common aromatizers being menthol dissolved in a highly volatile alcohol. A known process underlying the precharacterizing part of claim 1 is disclosed in German Patent 22 54 063 following which the liquid containing the aromatizer is sprayed onto the tobacco before the latter leaves the suction conveyer on which a tobacco strand has been produced. Shortly after the spraying operation, the tobacco strand is wrapped with cigarette paper. The aromatizer-containing liquid is added to the final tobacco strand directly in advance of the wrapping point so that the distributor is not imbibed with the liquid.

The known process entails the risk of stain formation on the cigarette paper due to liquid externally sprayed onto the tobacco strand, which, while being wrapped with cigarette paper, is not yet soaked sufficiently deeply with said liquid. Further, liquid atomized by air pressure tends to crystallize so that solid crystals are contained in the tobacco strand in which the aromatizer is bound.

SUMMARY OF THE INVENTION

In case of the process of the invention, the liquid, rather than being sprayed onto the final tobacco layer, is inserted into an intermediate region in the unfinished tobacco layer onto which further tobacco is subsequently added. By this means, a distribution of the liquid present inside the tobacco strand may subsequently take place to the outside. However, no high liquid accumulations will ever get to the outside of the tobacco strand. Therefore, the wrapping, e.g. cigarette paper, will not be imbibed with liquid.

The process of the invention is primarily suited for, although not restricted to the production of cigarettes. Also cigars, cigarillos and other smoking material may be produced this way. Furthermore, the process of the invention is not restricted to the introduction of menthol into the tobacco, but other odorous and flavoring components may be also introduced in liquid form into the tobacco.

Prior to the completion of the tobacco strand, liquid is introduced into a region which later forms the central range of the tobacco strand and from which the aroma uniformly diffuses through the total tobacco stock.

The liquid is preferably inserted into the tobacco as a thin, non-sprayed jet applied without the use of compressed air so that the formation of crystals is avoided.

It has been generally known to control or regulate the pressure used to feed the liquid to an injection means spraying it onto the tobacco responsive to the operating speed of a cigarette making machine. However, such a control is accompanied by a considerable time lag because the line system extending from the pressure source to the injection means contains a high liquid volume. Hence, with a changing working speed of the cigarette making machine, a substantial part of the tobacco material is provided with an amount of liquid inconsistent with the working speed. According to a preferred embodiment of the apparatus of the invention, the liquid line extending from the pump to the injection means has an inner diameter of less than 1 mm, preferably of about 0.5 mm. Thus, the liquid volume contained in the liquid line is low, and, as a result thereof, the adaptation of the liquid amount to the working speed of the machine is realized with a short reaction time. Since a liquid line of such a narrow design is accompanied by a high pressure loss, the pump for feeding the liquid must deliver a high pressure in the order of 50 bar. The injection means does not comprise a nozzle or constriction so that the injected liquid amount is proportional to the feed pressure.

BRIEF DESCRIPTION OF THE DRAWINGS

An embodiment of the invention will be explained hereunder in more detail with reference to the drawings.

DETAILED DESCRIPTION OF THE PREFERRED EMBODIMENT

Figure 1:
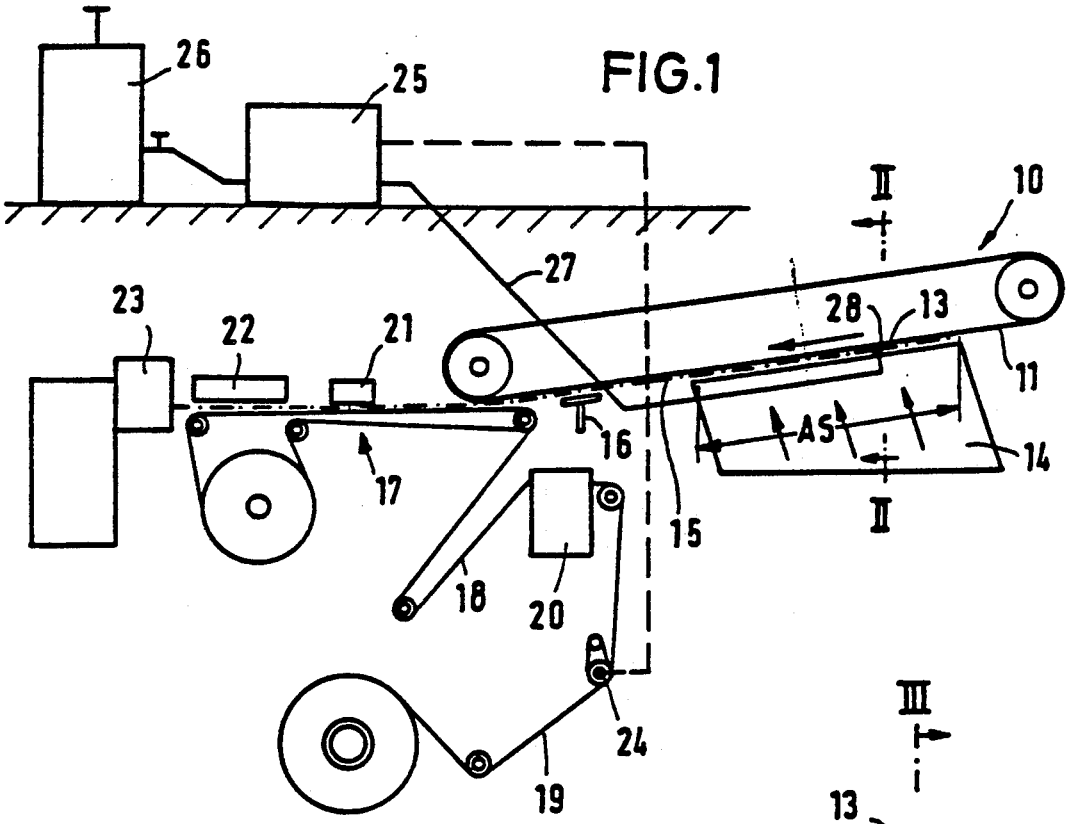
FIG. 1 is a schematic view of a portion of a cigarette making machine.

The illustrated cigarette making machine comprises a suction conveyer 10 whose lower side 11 is used for depositing a tobacco layer 15, the conveyer belt of the suction conveyer 10 being of the suction type 13 whose inside confines a suction chamber connected to a (non-illustrated) suction means. Beneath the lower belt side 11 of the suction conveyer 10, there is a container 14 to which loose tobacco is fed from below, said container 14 being confined laterally by walls 14a, and at the top end by the suction belt 13 forming the lower belt side 11. Hence, tobacco present in the container is absorbed upwardly while tobacco at the underside of suction belt 13 forms a layer 15 which is retained by the suction effect of the suction belt 13. The accumulation of tobacco takes place over a path AS corresponding to the length of the upper container opening 14 (in conveying direction of the suction belt 13).

In the final region of the conveyer path formed by the lower belt side 11, there is a trimmer 16 formed by a rotating plate for trimming the tobacco layer to a predetermined cigarette tobacco weight.

From the suction belt 13, tobacco layer 15 is placed on a belt conveyer 17 to which, furthermore, the wrapping 18 is added in the form of cigarette paper.

The wrapping 18 which is drawn off a spare roller 19 is conducted over a plurality of guide rollers to the belt conveyer, but a print is previously applied in a printing means 20. In a coating station 21, adhesive is applied to a longitudinal edge of the cigarette paper, and in a closing station 22, the tobacco strand wrapped by the cigarette paper is closed. Subsequently, the individual cigarettes are cut to length by a cutting means 23.

The working speed of the cigarette making machine is determined by an angular signal generator 24 which measures the speed of the rollers. The signal of the angular signal generator 24 is supplied to a smoothly operating high pressure pump 25 absorbing from a reservoir 26 the aromatic substance-containing liquid to feed it to a conduit 27 extending to the injection means 28.

Said injection means 28 mounted inside container 14 is formed of the outlet of a capillary tube 30 which is joined to the liquid conduit 27. The injection means 28 is disposed nearly at the end of the first third of length of the depositing path AS where the tobacco layer 15*a* having accumulated at the suction belt 13 is nearly half as thick as the final tobacco layer 15.

Figure 2:
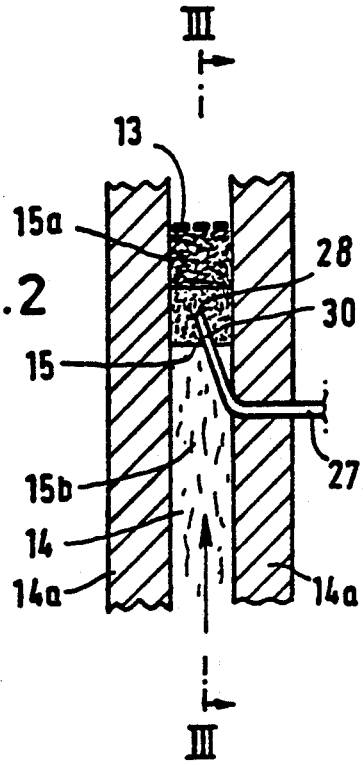
FIG. 2 is a scaled up section along line II—II of FIG. 1.

No. 15*a* of FIG. 2 refers to the tobacco having already accumulated at the point of the injection means 28, while 15 shows the final tobacco layer as it leaves the settling path As and 15*b* designates the tobacco still hovering in container 14 and not yet having settled down.

Figure 3:
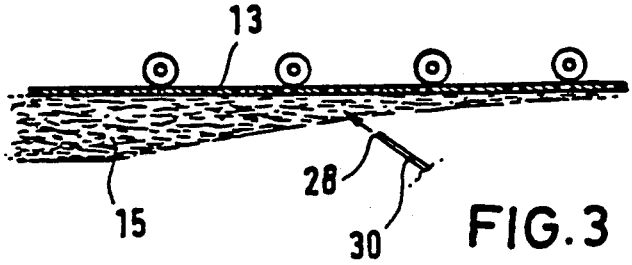
FIG. 3 is a section along line III—III of FIG. 2.

As obvious from FIG. 3, the injection means 28 is inclined upwardly in conveying direction of the suction belt 13, and it is positioned nearly in the center of the container width. From the injection means 28, an airless, concentrated liquid jet is sprayed against the tobacco without a risk of crystallization. Further, due to the disclosed arrangement of the injection means, tobacco accumulations in the suction channel are excluded. In the further course of the settling path AS, further tobacco is accumulated after the liquid injection so that liquid contained in the tobacco is covered by the additional tobacco accordingly.

In operation of the cigarette making machine, the suction belt 13 absorbs tobacco from container 14, said tobacco accumulating from below at the suction belt to form a layer 15*a* constantly growing in height. As soon as said layer has reached nearly half the final size, liquid is sprayed against the underside of the layer. At the end of the suction conveyer 10, the final tobacco layer is trimmed by trimmer 16, placed on tobacco paper, round-shaped, and, after all, the cigarette paper is closed and bonded by adhesive, whereupon the individual cigarette lengths are cut off.

Responsive to the operating speed of the cigarette making machine, the pressure of the high pressure pump 25 is controlled by the angular signal generator 24 thus ensuring that the injected amount of liquid remains constant per unit of length of the tobacco layer. To obtain short response time of said control system, the opening cross section of the liquid conduit 27 is very small.

The operation of the liquid charge may not be only continuous, as disclosed, but also discontinuous.

What is claimed is:

1. A process for producing aromatized strand-shaped smoking material in a strand machine comprising feeding tobacco for the formation of a tobacco layer (15) of increasing thickness via a settling path (AS) to a conveyer (10) and subsequently forming the tobacco layer into a strand, providing it with a wrapping (18) and dividing it into longitudinal sections, a liquid containing an aromatic substance being added to the tobacco during its transport, characterized in that while the tobacco accumulates at the conveyer (10), the liquid is inserted into a region which, upon termination of the tobacco accumulation, corresponds to the center of the thickness of the tobacco layer (15) onto which additional tobacco is deposited thereon, and characterized in that the liquid is applied in an airless jet.

2. The process as set forth in claim 1, characterized in that the liquid is applied discontinuously.

3. Apparatus for producing aromatized strand-shaped smoking material with a cigarette making machine as claimed in claim 1 or 2, comprising a suction conveyer (10) for accumulating a tobacco layer (15), there being provided in the area of the settling path (AS) of the suction conveyer (10) an injection means (28) for conducting liquid to the already settled tobacco, characterized in that the pressure of a pump (25) delivering the liquid is controlled responsive to the operating speed of the cigarette making machine and that the diameter of the liquid conduit (27) extending from the pump (25) to the injection means (28) is less than 1 mm.

* * * * *